US008317303B2

(12) United States Patent
Ishikawa

(10) Patent No.: US 8,317,303 B2
(45) Date of Patent: Nov. 27, 2012

(54) LIQUID-DROPLET JETTING APPARATUS AND METHOD FOR PRODUCING THE SAME

(75) Inventor: Hiroyuki Ishikawa, Nisshin (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 870 days.

(21) Appl. No.: 11/890,750

(22) Filed: Aug. 7, 2007

(65) Prior Publication Data

US 2008/0036824 A1 Feb. 14, 2008

(30) Foreign Application Priority Data

Aug. 8, 2006 (JP) ..... 2006-215378

(51) Int. Cl.
*B41J 2/045* (2006.01)

(52) U.S. Cl. ..... 347/71

(58) Field of Classification Search ..... 347/71
See application file for complete search history.

(56) References Cited

U.S. PATENT DOCUMENTS 5,420,627 A * 5/1995 Keefe et al. ..... 347/87
6,270,198 B1 * 8/2001 Ahn et al. ..... 347/63
6,561,626 B1 * 5/2003 Min et al. ..... 347/47
2001/0002839 A1 * 6/2001 Ishii ..... 347/71
2003/0218659 A1 * 11/2003 Ito ..... 347/71

FOREIGN PATENT DOCUMENTS

JP 2001-301167 10/2001

* cited by examiner

*Primary Examiner* — Uyen Chau N Le
*Assistant Examiner* — Hoang Tran
(74) *Attorney, Agent, or Firm* — Frommer Lawrence & Haug LLP

(57) ABSTRACT

A liquid-droplet jetting apparatus includes a pressure-applying mechanism and a channel unit. The channel unit has a stacked body made of a plurality of metal plates. A plurality of pressure chambers arranged in a row in one direction, a plurality of manifolds which are arranged to be mutually adjacent and which extend in the one direction, and a plurality of communication channels each communicating one of the pressure chambers with one of the manifolds are formed in the stacked body. Here, the communication channels have channel resistances which are same. It is possible to divide the manifold into a plurality of divided manifold portions, and the construction of the channel unit as a whole can be made compact while suppressing the variation in jetting characteristic, thereby making the size of the liquid-droplet jetting apparatus to be small.

12 Claims, 13 Drawing Sheets

LIQUID-DROPLET JETTING APPARATUS AND METHOD FOR PRODUCING THE SAME

CROSS REFERENCE TO RELATED APPLICATION

The present application claims priority from Japanese Patent Application No. 2006-215378 filed on Aug. 8, 2006, the disclosure of which is incorporated herein by reference in its entirety.

BACKGROUND OF THE INVENTION

1. Field of the Invention

The present invention relates to a liquid-droplet jetting apparatus which jets a liquid droplet of a liquid and to a method for producing the liquid-droplet jetting apparatus.

2. Description of the Related Art

As a liquid-droplet jetting apparatus jetting liquid droplets, Japanese patent application laid-open No. 2001-301167 (see FIGS. 2 and 3) discloses an ink-jet head which records a desired image, letter and/or the like on a recording paper by jetting an ink from nozzles onto the recording paper. The ink-jet head described in Japanese patent application laid-open No. 2001-301167 is provided with a plurality of nozzles, a plurality of pressure chambers which communicate with the nozzles respectively and which are arranged in a row in a row direction, and two manifolds which communicate with the pressure chambers and which extend on both sides of the row of the pressure chambers (pressure-chamber row) respectively, along the row direction of the pressure chambers. When an actuator applies pressure to the ink supplied from the manifolds to the pressure chambers, the ink is jetted from the nozzles communicating with the pressure chambers respectively.

Here, the pressure chambers arranged in one row are communicated with the two manifolds such that adjacent pressure chambers among the pressure chambers are communicated alternately with the two manifolds which are arranged at the both sides of the pressure-chamber row. Namely, different manifolds supply the ink to the two adjacent pressure chambers respectively. Therefore, it is possible to prevent the change in pressure (pressure change) generated in a certain pressure chamber from propagating via the manifold to another pressure chamber adjacent to the certain pressure chamber, thereby suppressing occurrence of the crosstalk.

In the ink-jet head of Japanese patent application laid-open No. 2001-301167 as described above, however, the pressure-chamber row is arranged between the two manifolds. Therefore, the two manifolds are arranged to be apart from each other, which in turn makes the structure of channels (flow passages) as a whole becomes wide across a plane in which the pressure chambers are arranged, thereby consequently making the ink-jet head to be large by the wide size of the channel construction. Also, when an attempt is made to arrange the two manifolds adjacent closely with each other to thereby make the channel structure to be compact, there arises the following problem. That is, in such a case, the lengths of channels, communicating the pressure chambers and manifolds respectively, need to be different among the pressure chambers. Due to this, an amount of the ink supplied to the plurality of pressure chambers (ink supply amount) is different or varied among the pressure chambers. Therefore, the variation in liquid-droplet jetting characteristic becomes great among the plurality of nozzles communicating with the pressure chambers respectively.

SUMMARY OF THE INVENTION

An object of the present invention is to provide a liquid-droplet jetting apparatus in which a channel structure thereof can be made compact as a whole by dividing, into a plurality of portions, a liquid supply chamber (manifold) supplying a liquid to a plurality of pressure chambers arranged in a row in one direction, thereby making it possible to make the size of the apparatus to be compact while suppressing the variation in jetting characteristic. Another object of the present invention is to provide a method for producing such a liquid-droplet jetting apparatus.

According to a first aspect of the present invention, there is provided a liquid-droplet jetting apparatus which jets a droplet of a liquid, including: a channel unit having a liquid channel formed therein, the liquid channel having a plurality of nozzles, a plurality of pressure chambers which communicate with the nozzles respectively and which are arranged in a row in a predetermined plane along a predetermined row direction, and a plurality of liquid supply chambers which are arranged to be mutually adjacent and which extend in the predetermined row direction, and a plurality of communication channels each of which communicates one of the pressure chambers and one of the liquid supply chambers and which are formed in a shape so that the communication channels have channel resistances which are same; and a jetting-pressure applying mechanism which applies jetting pressure to the liquid in the pressure chambers.

In this liquid-droplet jetting apparatus, the liquid is supplied to the pressure chambers from the liquid supply chambers via the communication channels respectively, and pressure is applied to the ink in the pressure chambers by the jetting-pressure applying mechanism, to thereby jet droplets of the liquid (liquid droplets) from the nozzles communicating with the pressure chambers respectively. Here, a liquid supply chamber supplying the liquid to the plurality of pressure chambers arranged in a row in the predetermined row direction is divided into a plurality of portions (plurality of liquid supply chambers), and these liquid supply chambers are arranged to be mutually adjacent as viewed from an orthogonal direction orthogonal to the plane (arrangement plane), on which the pressure chambers are arranged, and each of the liquid supply chambers extends in parallel to the row direction of the pressure chambers. Note that the phrase "liquid supply chambers are arranged to be mutually adjacent" means a state or aspect that adjacent liquid supply chambers among the plurality of liquid supply chambers are arranged to be close to each other without any channel portion such as a pressure chamber being arranged between the adjacent liquid supply chambers. Accordingly, it is possible to make the liquid channel including the pressure chambers and the like to be compact as a whole, thereby making the liquid-droplet jetting apparatus to be compact as well.

In addition, by communicating mutually adjacent pressure chambers, among the plurality of pressure chambers, with different liquid supply chambers among the plurality of liquid supply chambers respectively, it is possible to prevent the pressure change generated in a certain pressure chamber from propagating to a pressure chamber or chambers adjacent to the certain pressure chamber via the liquid supply chamber or chambers. Thus, the crosstalk can be suppressed. Further, the channel resistance is same among the communication channels which communicate the pressure chambers and the liquid supply chambers respectively. Therefore, the variation in the liquid supply amount, of the liquid supplied from the liquid supply chambers to the pressure chambers, is small, which consequently makes the variation in liquid-droplet jetting characteristic (such as velocity of liquid-droplet, volume of liquid droplet, etc.) to be small among the plurality of nozzles. Here, the phrase "the communication channels have channel resistances which are same" includes the state that "the communication channels have channel resistances which are substantially same".

In the liquid-droplet jetting apparatus of the present invention, the communication channels may have channel lengths which are same and channel cross sectional areas which are same. Since the channel length and channel cross sectional area are both mutually same among the plurality of communication channels, the channel resistance is same among the plurality of communication channels.

In the liquid-droplet jetting apparatus of the present invention, the plurality of communication channels may have main portions extending in a predetermined extending direction respectively; and main portions, of two communication channels among the plurality of communication channels and communicating two adjacent pressure chambers among the plurality of pressure chambers, may extend in mutually different directions. In this case, it is possible to make the channel length and the channel cross sectional area to be same among the plurality of communication channels, thereby making the channel resistance to be same among the plurality of communication channels.

In the liquid-droplet jetting apparatus of the present invention, the plurality of communication channels may have channel lengths which are mutually different; and among the plurality of communication channels, a communication channel having a longer channel length than another communication channel may have a larger channel cross sectional area than that of the another communication channel. Accordingly, in a case that the channel length is made different among the plurality of communication channels, the cross sectional areas of the communication areas are adjusted such that as a certain communication channel, among the communication channels, has a longer channel length, the certain communication channel has a larger cross sectional area, thereby making it possible to make the channel resistance to be same among the communication channels.

In the liquid-droplet jetting apparatus of the present invention, the plurality of communication channels may have main portions extending in an orthogonal direction orthogonal to the predetermined row direction. In this case, the liquid channel including the pressure chambers and the communication channels can be made to be further compact.

In the liquid-droplet jetting apparatus of the present invention, the plurality of communication channels may have main portions extending in a predetermined extending direction respectively; and the main portions of the communication channels may be arranged in another plane parallel to the plane. In this case, since the main portions of the communication channels are arranged in the plane parallel to the arrangement plane of the pressure chambers, it is possible to make the channel unit, in which the liquid channel is formed, to be thin.

In the liquid-droplet jetting apparatus of the present invention, the pressure chambers and the liquid supply chambers may be partially overlapped. In this case, since the pressure chambers and the liquid supply chambers are arranged to overlap with each other at least partially, it is possible to make the liquid channel including the pressure chambers and the liquid supply chambers to be formed in a compact manner.

In the liquid-droplet jetting apparatus of the present invention, the nozzles may be arranged in a row in the row direction of the pressure chambers. In this case, the pressure chambers and the nozzles communicating with the pressure chambers respectively are arranged in rows in mutually parallel directions respectively. Accordingly, the liquid channel can be formed to be compact.

In the liquid-droplet jetting apparatus of the present invention, the channel unit may have a stacked body formed of a plurality of metal plates including a plate in which the liquid supply chambers are formed.

When at least a part of the channel unit is formed by stacking a plurality of metal plates in which holes and/or grooves forming the channel unit are formed, it is possible to bond or join the metal plates by metal diffusion bonding. When the metal diffusion bonding is adopted, a plurality of pieces of metal plates can be joined at a time because the plates are stacked and heated in the stacked state at a high temperature to be joined together. However, when the plurality of metal plates include a plate in which a cavity having a wide area in the plane direction of the plate is formed, the plates are not sufficiently pressurized at an area facing or opposite to the cavity, thereby rendering the joining insufficient in some cases. On the other hand, according to the present invention, the liquid supply chamber, which is most likely to be formed as the cavity having a large base area among the elements or components constructing the liquid channel, is divided into a plurality of portions (plurality of liquid supply chambers). Consequently, the area of each of the divided liquid supply chambers can be made small, thereby making it possible to join the metal plates by the metal diffusion bonding in an assured manner.

In the liquid-droplet jetting apparatus of the present invention, the plurality of liquid supply chambers may have a communication portion formed at one ends in the predetermined row direction of the liquid supply chambers, the communication portion extending to communicate the liquid supply chambers with each other. In this case, since the communication portion communicating the liquid supply chambers mutually is formed, it is possible to supply the ink to the liquid supply chambers by, for example, providing on the communication portion a supply port from which the ink is supplied.

In the liquid-droplet jetting apparatus of the present invention, the plurality of pressure chambers may have through holes formed therein respectively, each of the through holes communicating one of the pressure chambers and one of the liquid supply chambers; and through holes, among the through holes, which are formed in two adjacent pressure chambers among the plurality of pressure chambers, may be formed at mutually different positions in an orthogonal direction orthogonal to the predetermined row direction. In this case, since the through holes formed in the two adjacent pressure chambers are formed at mutually different positions in the orthogonal direction to the predetermined row direction. Accordingly, it is possible to communicate the adjacent pressure chambers to the different liquid supply chambers respectively, thereby reducing the crosstalk.

According to a second aspect of the present invention, there is provided a liquid-droplet jetting apparatus which jets a droplet of a liquid, including:

a channel unit having a liquid channel formed therein, the liquid channel including: a plurality of nozzles; a plurality of pressure chambers which communicate with the nozzles respectively and which are arranged in a row in a predetermined plane along a predetermined row direction; a supply chamber having a plurality of extending portions which are arranged to be mutually adjacent, which extend in the predetermined row direction and which overlap with the pressure chambers, and a connection portion which is formed at one end of the supply chamber in the predetermined row direction and which connects the extending portions with each other; and a plurality of communication channels each of which communicates one of the pressure chambers and one of the extending portions; and a jetting-pressure applying mechanism which applies jetting pressure to the liquid in the pressure chambers.

According to the second aspect of the present invention, the supply chamber (liquid supply chamber) supplying the liquid to the plurality of pressure chambers arranged in a row in the predetermined row direction has a plurality of extending portions, and these extending portions are arranged to be mutually adjacent as viewed from an orthogonal direction orthogonal to the arrangement plane of the pressure chambers. Accordingly, it is possible to form the liquid channel including the pressure chambers to be compact as a whole, thereby making the size of the liquid-droplet jetting apparatus to small as well. Further, by communicating mutually adjacent pressure chambers, among the plurality of pressure chambers, with different extending portions respectively, it is possible to prevent the pressure change generated in a certain pressure chamber from propagating to another pressure chamber or chambers adjacent to the certain pressure chamber via the extending portion or portions of the liquid supply chamber. Thus, the crosstalk can be suppressed. Furthermore, since the liquid supply chamber is divided by the plurality of extending portions, the area of each of the extending portions of the liquid supply chamber is made to be small. Accordingly, when the channel unit is formed by stacking a plurality of metal plates, the joining of the metal plates by the metal diffusion bonding can be performed in an assured manner.

According to a third aspect of the present invention, there is provided a method for producing a liquid-droplet jetting apparatus which jets a droplet of a liquid, the method including: preparing a plate in which a plurality of nozzles are formed; preparing a plurality of metal plates; forming a liquid channel in the plurality of metal plates by forming, in a part of the metal plates, a plurality of liquid supply chambers which are arranged to be mutually adjacent and which extend in a predetermined direction and a plurality of pressure chambers arranged in a row in the predetermined direction; stacking the metal plates; forming a stacked body by joining the stacked metal plates by metal diffusion bonding; providing a jetting-pressure applying mechanism which applies jetting pressure to the liquid in the pressure chambers; and joining, to the stacked body, the jetting-pressure applying mechanism and the plate in which the nozzles are formed; wherein in the formation of the channel unit, a plurality of communication channels each of which communicates one of the pressure chambers and one of the liquid supply chambers are formed in a shape so that the communication channels have channel resistances which are same.

According to the method for producing the liquid-droplet jetting apparatus, in the step of forming the liquid channel, a liquid supply chamber supplying the liquid to the plurality of pressure chambers arranged in a row in the predetermined row direction are formed to be divided into a plurality of portions (plurality of liquid supply chambers). Here, by arranging the plurality of liquid supply chambers to be mutually adjacent as viewed from the orthogonal direction orthogonal to the arrangement plane of the pressure chambers, it is possible to make the liquid channel including the plurality of pressure chambers to be compact as a whole, thereby making the apparatus to be small as well. In addition, since the area of each of the liquid supply chambers is made small, the joining of the metal plates by the metal diffusion bonding can be performed in an assured manner.

Further, by communicating adjacent pressure chambers, among the plurality of pressure chambers, with different liquid supply chambers among the plurality of liquid supply chambers respectively, it is possible to prevent the pressure change generated in a certain pressure chamber from propagating to another pressure chamber or chambers adjacent to the certain pressure chamber via the liquid supply chamber or chambers. Thus, the crosstalk can be suppressed. Further, by making the communication channels, each of which communicates one of the pressure chambers and one of the liquid supply chambers, have channel resistances which are same, it is possible to suppress the variation in the liquid supply amount, of the liquid supplied from the liquid supply chambers to the pressure chambers, to be small, which consequently makes the variation in liquid-droplet jetting characteristic (such as velocity of liquid-droplet, volume of liquid droplet, etc.) to be small among the plurality of nozzles.

BEST MODE FOR CARRYING OUT THE INVENTION

An embodiment of the present invention will be described. This embodiment is an example in which the present invention is applied to an ink jet head (liquid-droplet jetting apparatus) which records a desired image, character and/or the like by jetting droplets of an ink (ink droplets) onto a recording paper.

Figure 1:
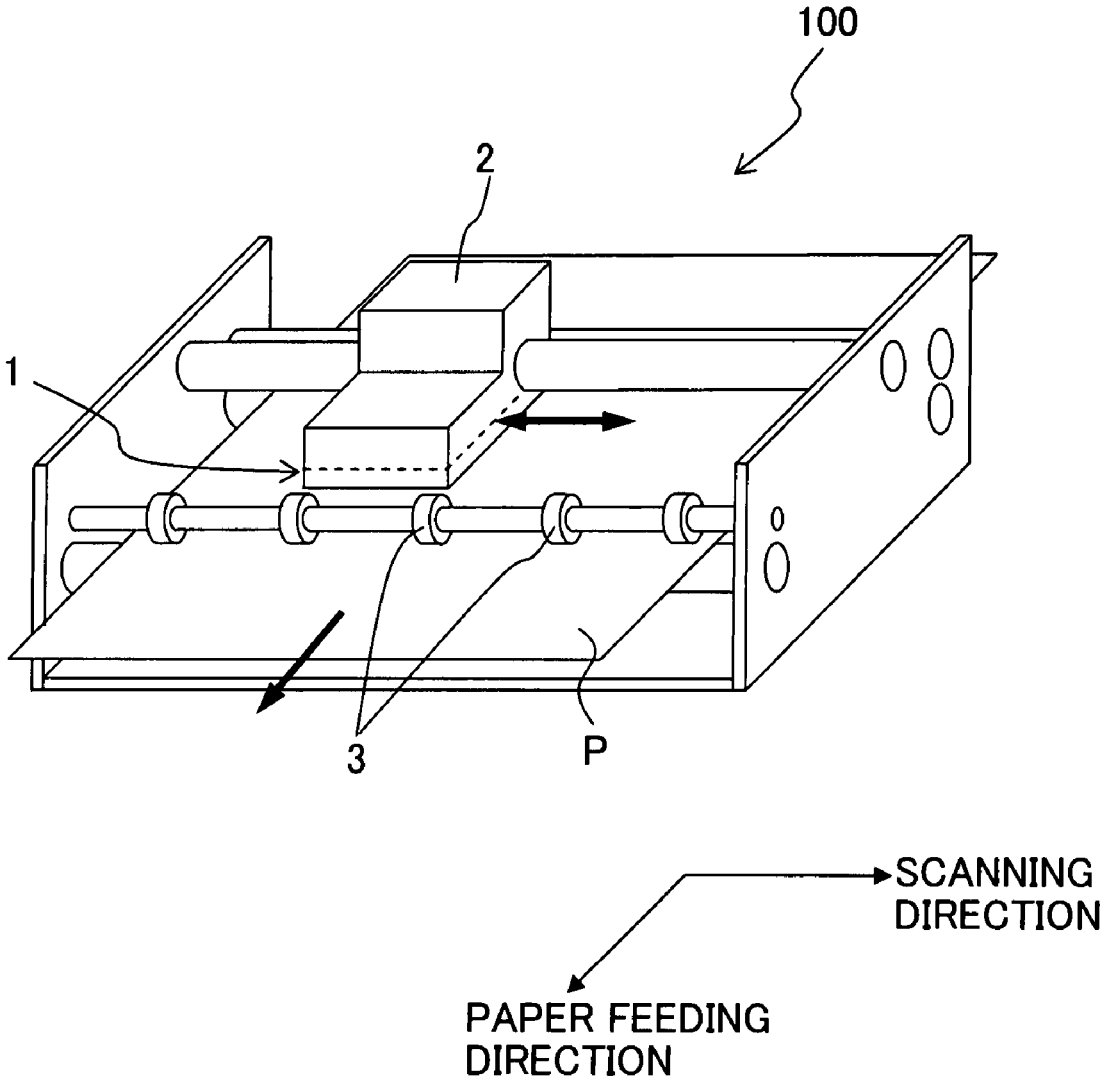
FIG. 1 is a view showing a general construction of an ink jet printer according to an embodiment of the present invention.

First, an ink jet printer including the ink jet head of this embodiment will be described briefly. As shown in FIG. 1, an ink jet printer 100 includes a carriage 2 movable in the left and right direction of FIG. 1, a serial type ink jet head 1 which is provided on the carriage 2 and which jets an ink onto a recording paper P, and feed rollers 3 which feed or transport the recording paper P toward the front of FIG. 1 (paper feeding direction, as indicated by an arrow). The ink jet head 1 moves in the left and right direction (scanning direction, as indicated by an double-pointed arrow) integrally with the carriage 2 and jets the ink onto the recording paper P from nozzles 20 (see FIGS. 2 to 6) arranged on the lower surface of the ink jet head 1 to record desired character and/or image etc. The recording paper P on which the image and/or the like has been recorded by the ink jet head 1 is discharged to the paper feeding direction by the feed rollers 3.

Figure 2:
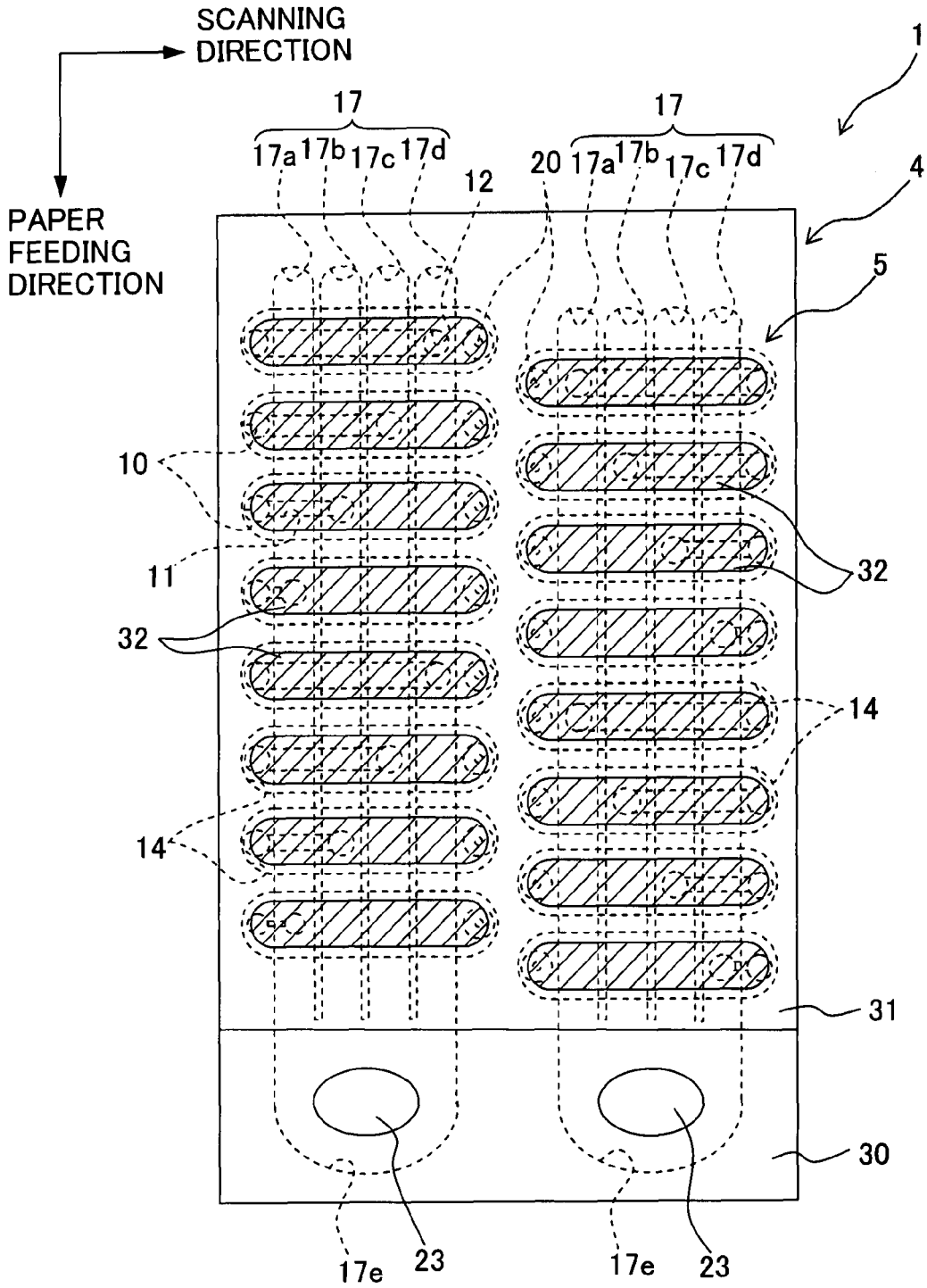
FIG. 2 is a plan view of an ink jet head.
Figure 3:
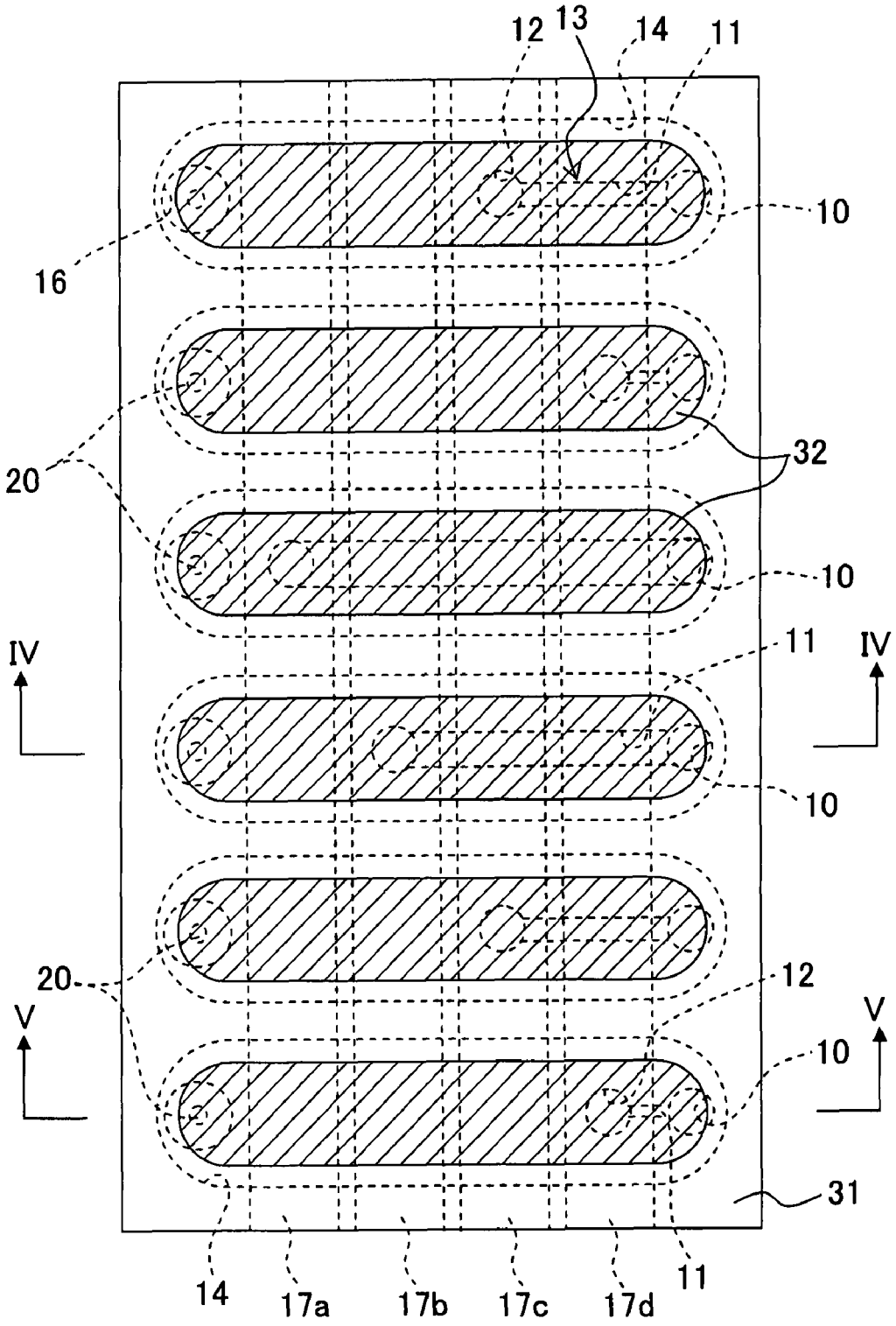
FIG. 3 is a partially enlarged view of FIG. 2.
Figure 4:
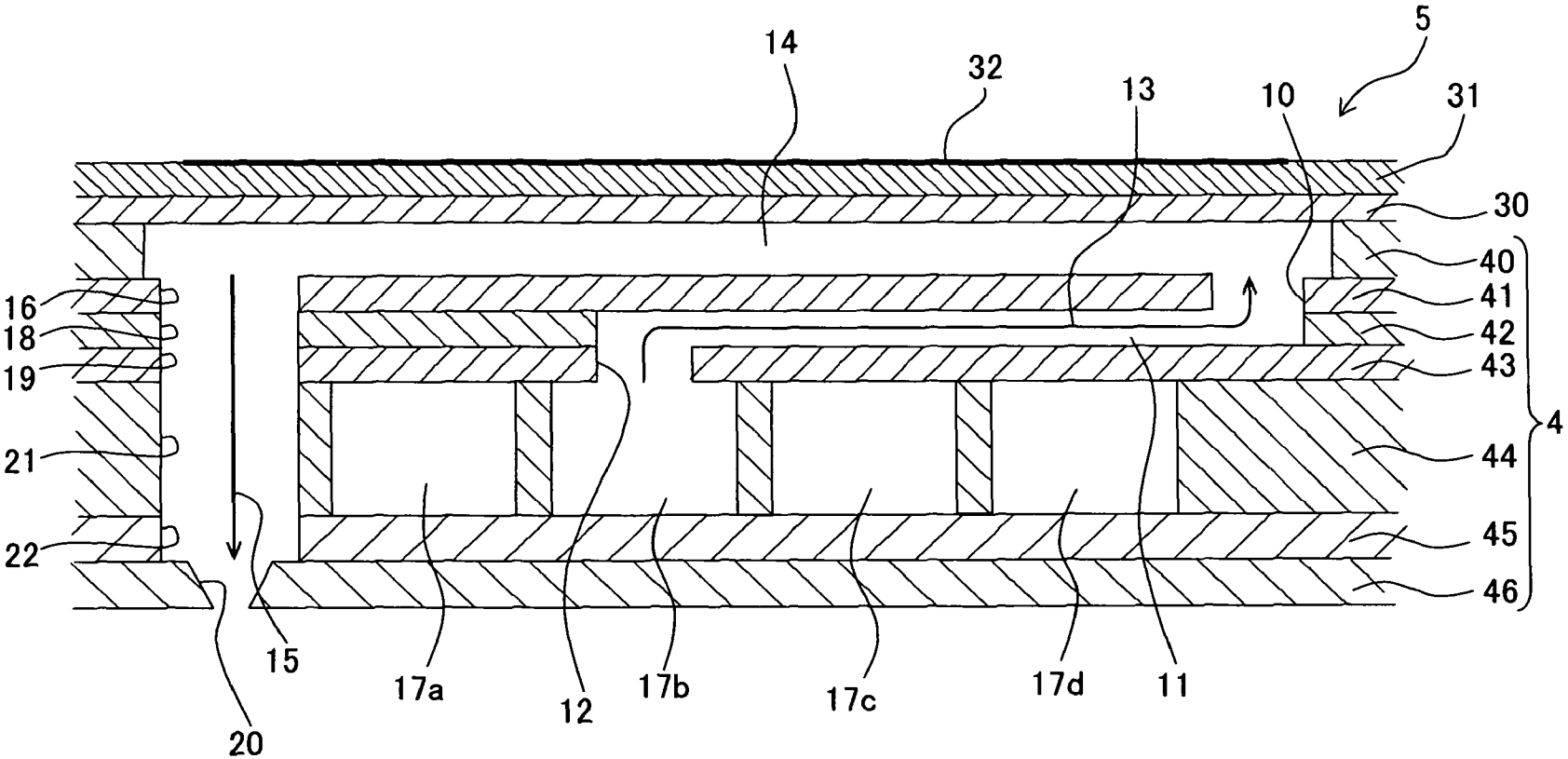
FIG. 4 is a sectional view taken along the IV-IV line of FIG. 3.
Figure 5:
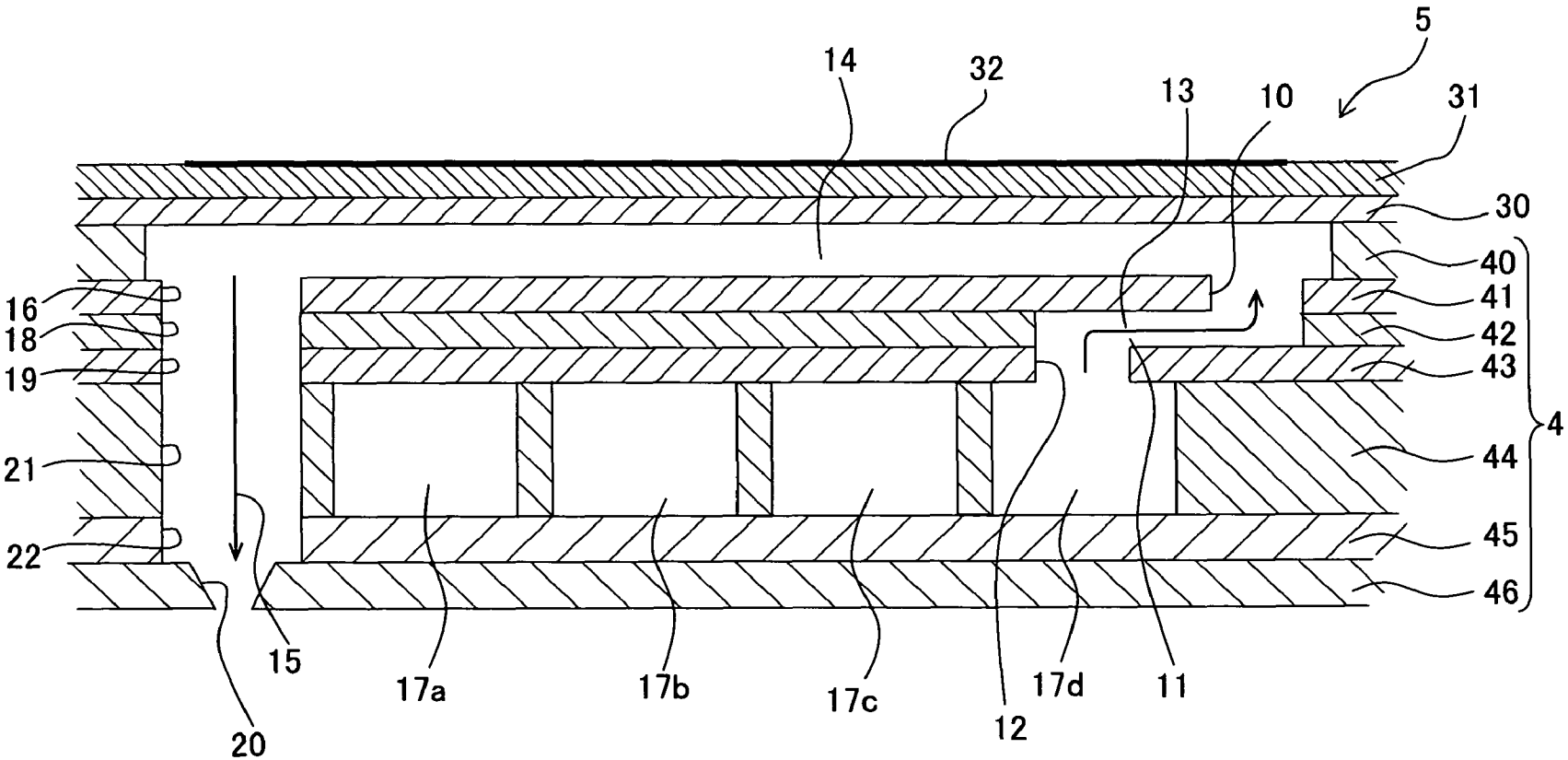
FIG. 5 is a sectional view taken along the V-V line of FIG. 3.
Figure 6:
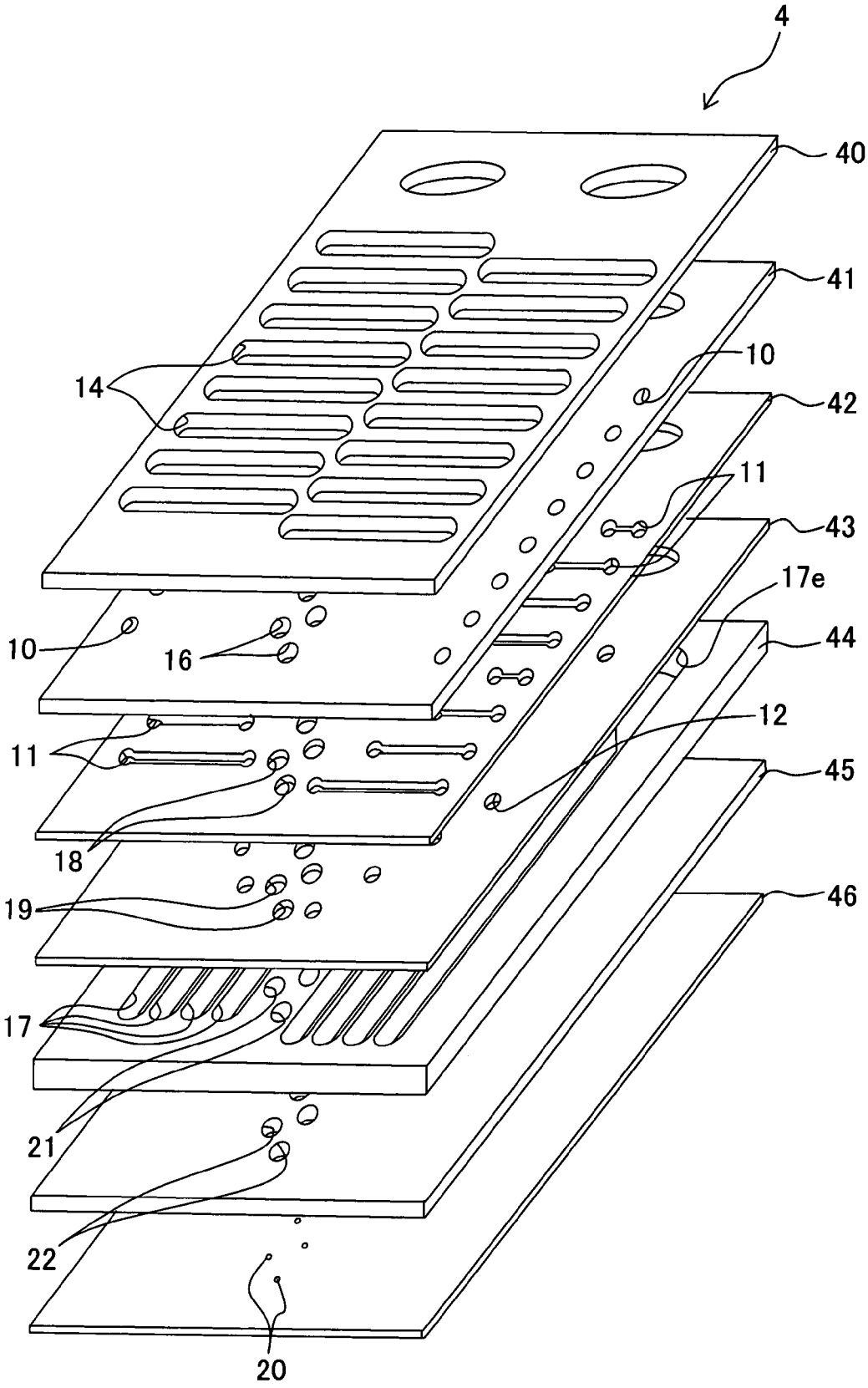
FIG. 6 is an exploded perspective view of a channel unit.

Next, the ink jet head will be described with reference to FIGS. 2 to 6. FIG. 2 is a plan view of the ink jet head, and FIG. 3 is a partially enlarged view of FIG. 2. FIG. 4 is a sectional view taken along the IV-IV line of FIG. 3, and FIG. 5 is a sectional view taken along the V-V line of FIG. 3. FIG. 6 is an exploded perspective view of a channel unit 4 included in the ink jet head 1.

As shown in FIGS. 2 to 6, the ink jet head 1 includes a channel unit 4 in which an ink channel (liquid channel) including the nozzles 20, pressure chambers 14, and manifolds 17 (liquid supply chambers) are formed; and a piezoelectric actuator 5 (jetting-pressure applying mechanism) which applies a jetting pressure to the ink inside the pressure chambers 14.

First, the channel unit 4 will be described. As shown in FIGS. 4 to 6, the channel unit 4 includes a cavity plate 40, a base plate 41, an aperture plate 42, a supply plate 43, a manifold plate 44, a cover plate 45, and a nozzle plate 46. The shapes of these seven plates 40 to 46 are all rectangular shapes short in the scanning direction and elongated in the paper feeding direction. These seven plates 40 to 46 are stacked and joined to each other.

Among the seven plates 40 to 46 constructing the channel unit 4, six plates 40 to 45, except for the nozzle plate 46, are metal plates made of stainless steel or the like, and form a stacked body 50 together with a vibration plate 30 of the piezoelectric actuator 5 which will be described later on (see FIG. 7). In these six metal plates 40 to 45, the ink channel including the manifolds 17 and the pressure chambers 14 (to be described later) and the like can be easily formed by etching. The nozzle plate 46 is made of, for example, a high molecular synthetic resin material such as polyamide, and is joined or bonded to the lower surface of the manifold plate 44. Alternatively, this nozzle plate 46 may also be made of a metal material such as stainless steel similar to the six plates 40 to 45.

As shown in FIGS. 2 to 6, in the cavity plate 40 positioned in the uppermost layer among the seven plates 40 to 46, a plurality of pressure chambers 14 are formed by through holes penetrating through this plate 40, respectively, and these pressure chambers 14 are covered from above and below by the vibration plate 30 of the piezoelectric actuator 5 (to be described later) and by the base plate 41 respectively. The plurality of pressure chambers 14 are arranged in two rows in a staggered manner along the paper feeding direction (up and down direction in FIG. 2). Each of the pressure chambers 14 is formed to have a substantially elliptical shape long in the scanning direction (left and right direction in FIG. 2) in a plan view.

A plurality of through holes 10 are formed in the base plate 41 at areas thereof each overlapping with one ends (outer ends in the left and right direction in FIG. 2) of the pressure chambers 14 in a plan view (as viewed in a direction orthogonal to the arrangement plane of the pressure chambers 14), and the through holes 10 are arranged parallel to the row direction of the pressure chambers 14. In the aperture plate 42, throttle channels (apertures) 11 are formed. The throttle channels 11 are formed in the aperture plate 42 as narrow and elongated through holes extending, from the lower ends of the through holes 10, in the scanning direction (longitudinal direction of the pressure chambers 14) which is orthogonal to the row direction of the pressure chambers 14. Further, in the supply plate 43, through holes 12 which communicate with the tip ends (ends opposite to side of the through holes 10) of the throttle channels 11 are formed. The diameters of the through holes 10 and 12 corresponding to the plurality of pressure chambers 14, respectively, are all equal to each other. The through holes 10, throttle channels 11 and through holes 12 construct communication channels 13 each of which communicates one of the pressure chambers 14 and one of the manifolds 17 (to be described later).

Here, the channel resistances of the communication channels 13 which communicate the pressure chambers 14 and the manifolds 17 are determined depending on the channel lengths and the channel cross-section areas (areas of cross-sections orthogonal to the channel center lines). However, in the channel unit 4 of this embodiment, the positions of the through holes 12 in the supply plate 43 (namely, communication positions at which the through holes 12 communicate with the manifolds 17, to be described later) are different in the longitudinal direction of the pressure chambers 14, as shown in FIGS. 2 and 3. Accordingly, the lengths of the throttle channels 11 each of which extends in the longitudinal direction of one of the pressure chambers 14 and each of which connects two kinds of through holes, namely one of the through holes 10 and one of the through holes 12 are different among the throttle channels 11. Further, the lengths of the throttle channels 11 are longer than the lengths (heights) of the through holes 10 and 12 (that is, longer than the thickness of the base plate 41 and the thickness of the supply plate 43) (namely, each of the throttle channels 11 occupy a substantial or main portion of one of the communication channels 13). Consequently, the difference in length among the throttle channels 11 greatly influence the channel resistance of the communication channels 13.

In this embodiment, however, as shown in FIGS. 2 and 3, as the length of a certain throttle channel 11 is greater, the width of the certain throttle channel is greater. Further, the throttle channels 11 are formed of holes penetrating through the throttle channel plate 42, and channel heights of the throttle channels 11 are all equal to each other. Therefore, the channel cross-section areas of the throttle channels 11 are in proportion to the widths of the throttle channels 11. Therefore, the longer the throttle channel 11 is, the larger the channel cross-section area thereof is, and as a result, the plurality of communication channels 13 are equal to each other in the channel resistance.

In addition, since the throttle channels 11 as main portions of the communication channels 13 are arranged on one plane (aperture plate 42) parallel to the arrangement plane of the pressure chambers 14, the number of plates for forming the communication channels 13 can be minimized and the thickness of the channel unit 4 can be reduced.

As shown in FIGS. 4 and 5, through holes 16, 18, and 19 are formed in the base plate 41, aperture plate 42, and supply plate 43, respectively, at an area of each of the plates 41, 42 and 43 overlapping in a plan view with the other ends of the pressure chambers 14 (ends opposite to the side of the through holes 10), and the through holes 16, 18, and 19 form a part of a communication channel 15 communicating each of the pressure chambers 14 with one of the nozzles 20.

Manifolds 17 are formed in the manifold plate 44 at areas overlapping in a plan view with the two rows of the pressure chambers 14 (pressure-chamber rows) respectively. The manifolds 17 are formed of through holes penetrating through the manifold plate 44, and supply the ink to the plurality of pressure chambers 14. Each of the manifolds 17 extends along the row direction (paper feeding direction) of the pressure chambers 14 so as to cover the pressure chambers 14 forming one of the pressure-chamber rows. Through holes 21 are formed in the manifold plate 44 in an area thereof overlapping in a plan view with the other ends (ends on the side of the through holes 16) of the pressure chambers 14. Through holes 21 communicate with the through holes 19 of the supply plate 43 positioned above the manifold plate 44.

Here, as shown in FIGS. 2 and 3, each of the manifolds 17 corresponding to the plurality of pressure chambers 14 forming one of the pressure-chamber rows is divided into four manifolds (extending portions) 17*a* to 17*d*, and these four manifolds 17*a* to 17*d* are arranged to be mutually adjacent and extend parallel to each other along the row direction of the pressure chambers 14. That is, mutually adjacent manifolds 17*a* to 17*d* are arranged close to each other via only a partition wall which partitions the mutually adjacent manifolds, without any other channel or channels being arranged between these manifolds 17*a* to 17*d*. The pressure chambers 14, among the plurality of pressure chambers, forming one of the pressure-chamber rows are communicated with one of the four manifolds 17*a* to 17*d*, corresponding to one of the pressure-chamber rows, via the plurality of communication channels 13 respectively. By dividing the manifold 17 as a cavity having the largest base area in the ink channels formed inside the channel unit 4 into four manifolds in this manner, the width (area) of each of the manifolds 17 (17*a* to 17*d*) becomes small, thereby making it possible to obtain the following effect that, when the channel unit 4 is formed by joining the plurality of metal plates including the manifold plate 44 by metal diffusion bonding, the metal plates are joined in an assured manner. This will be described in detail again in the description of the method for producing the ink jet head 1 as will be explained later on.

The four manifolds 17*a* to 17*d* corresponding to one of the pressure-chamber rows are connected or merged at a base end (connecting portion, communication portion) 17*e* of the manifold 17 (lower ends in FIG. 2) to be communicated with each other. Further, the connecting portion (communication portion) 17*e* connecting the four manifolds 17*a* to 17*d* communicates with an external ink tank (not shown) via an ink supply channel 23 formed by through holes formed in the respective five plates (vibration plate 30, cavity plate 40, base plate 41, aperture plate 42, and supply plate 43) which are positioned above the manifold plate 44. Therefore, the ink is supplied to the four manifolds 17*a* to 17*d* via the ink supply channel 23 and the joining portion 17*e* from the ink tank, and this ink is further supplied to the plurality of pressure chambers 14 via the plurality of communication channels 13 respectively.

As described above, in the ink jet head 1 of this embodiment, the four manifolds 17*a* to 17*d* which supply the ink to one of the pressure-chamber rows extend parallel in a state that they are mutually adjacent to each other. Therefore, as compared with the construction in which the pressure-chamber row is arranged between two manifolds as shown in Japanese Patent Application Laid-open No. 2001-301167 as described above, the ink channel including the pressure chambers 14 and the manifolds 17 can be prevented from occupying a wide area or portion in the arrangement plane of the pressure chambers 14 and can be made compact, so that the channel unit 4, and eventually, the ink jet head 1 can be made small.

The four manifolds 17*a* to 17*d* and the plurality of pressure chambers 14 partially overlap in an area between the two kinds of through holes, namely between the through holes 10 and the through holes 16 each of which are positioned at both ends of one of the pressure chambers 14; and the manifolds 17*a* to 17*d* do not protrude to the outside of the pressure chambers 14 with respect to the longitudinal direction of the pressure chambers 14. Further, the throttle channels 11, as the main portions of the communication channels 13 communicating with the pressure chambers 14, extend in the orthogonal direction (longitudinal direction of the pressure chambers 14) orthogonal to the row direction of the pressure chambers 14. By employing such a construction, the pressure chambers 14, the manifolds 17, and the communication channels 13 can be arranged in a more compact manner.

The pressure chambers 14, among the plurality of pressure chambers, belonging to one of the pressure-chamber rows communicate with the four manifolds 17*a* to 17*d* in an arrangement order, by which the manifolds 17*a* to 17*d* are arranged in a row, via the plurality of communication channels 13. Namely, as shown in FIG. 3, a pressure chamber 14 positioned on one end (upper end in the drawing) in the row direction among the pressure chambers 14 communicates with the second manifold 17*c* from the right in the drawing, and another pressure chamber 14 next to the pressure chamber 14 at the one end communicates with the manifold 17*d* positioned at the right end in the drawing. Thus, the manifolds 17*a* to 17*d* communicate with the pressure chambers 14 in one pressure chamber row respectively, in a shifted manner one by one according to the arrangement order.

Therefore, the ink is supplied to the mutually adjacent two pressure chambers 14 from different manifolds 17 (17*a* to 17*d*), respectively. Therefore, when the piezoelectric actuator 5 (to be described later) applies, to the ink inside the pressure chambers 14, jetting pressure for jetting ink droplets of the ink from the nozzles 20, then the change in pressure of the ink inside a certain pressure chamber 14 is prevented from propagating to another pressure chamber 14 adjacent thereto via the manifold, thereby suppressing the crosstalk. By dividing the manifold 17 into four manifolds 17*a* to 17*d* (extending portions), the volume of each of the manifold 17*a* to 17*d* becomes small. However, the number of pressure chambers 14 to which one of the manifolds 17*a* to 17*d* supplies the ink is also reduced to ¼, thus there occurs no ink supply shortage to the pressure chambers 14.

In addition, in the channel unit 4 of this embodiment, since mutually adjacent pressure chambers 14 are communicated with different manifolds 17 (17*a* to 17*d*) respectively, the positions at which the through holes 12 are formed, at the ends of the communication channels 13 each of which communicates one of the pressure chambers 14 and one of the four manifolds 17*a* to 17*d* are different from each other. Further, the through holes 10 formed at the other ends of the communication channels 13 respectively, are located at the same position with respect to the longitudinal direction of the pressure chambers 14. Therefore, the length of the communication channel 13 are consequently different among the plurality of pressure chambers 14. However, as described above, the widths of the plurality of throttle channels 11 are properly adjusted such that the plurality of communication channels 13 have channel resistances which are same. Therefore, even when the ink is supplied to the plurality of pressure chambers 14 through the throttle channels 11 having different lengths, the variation in the supply ink amount is suppressed, and the variation in the liquid droplet jetting characteristic (liquid droplet speed, liquid droplet volume, etc.) among the plurality of nozzles 20 is made small.

Through holes 22 are formed in the cover plate 45 at an area thereof overlapping in a plan view with the other ends (ends on the side of the through holes 16) of the pressure chambers 14. The through holes 22 communicate with the through holes 21 of the manifold plate 44 positioned above the cover plate 45.

A plurality of nozzles 20 are formed in the nozzle plate 46 at positions at which the nozzles 20 overlap in a plan view with the other ends (ends on the side of the through holes 16) of the pressure chambers, respectively. As shown in FIG. 2, the plurality of nozzles 20 are arranged in two rows also in a staggered manner corresponding to the plurality of pressure chambers 14 arranged in two rows in a staggered manner along the paper feeding direction. Each of the nozzles 20 communicates with one of the pressure chambers 14 corresponding thereto via a communication channel 15 formed by the five kinds of through holes, namely the through holes 16, 18, 19, 21, and 22 formed in the five plates 41 to 45, respectively, the five plates being positioned between the cavity plate 40 and the nozzle plate 46. Thus, the plurality of nozzles 20 which respectively communicate with the pressure chambers 14 arranged in one of the pressure-chamber rows are arranged in a row in a direction parallel to the row direction of the pressure chambers 14. Accordingly, the ink channel including the pressure chambers 14 and the nozzles 20 can be arranged in more compact manner.

As shown in FIGS. 4 and 5, each of the manifolds 17 (17*a* to 17*d*) communicates with one of the pressure chambers 14 via one of the communication channels 13. Further, each of the pressure chambers 14 communicates with one of the nozzles 20 via one of the communication channels 15. Thus, a plurality of individual ink channels, each ranging from one of the manifold 17 (17*a* to 17*d*) to one of the nozzles 20 via one of the pressure chambers 14, are formed in the channel unit 4.

Next, the piezoelectric actuator 5 will be described. As shown in FIG. 2 to FIG. 5, the piezoelectric actuator 5 includes a vibration plate 30 disposed on the upper surface of the channel unit 4 (cavity plate 40), a piezoelectric layer 31 formed continuously on the upper surface of this vibration plate 31 to cover the plurality of pressure chambers 14, and a plurality of individual electrodes 32 disposed on the upper surface of the piezoelectric layer 31.

The vibration plate 30 is a metal plate having a substantially rectangular shape in a plan view, and is made of, for example, an iron-based alloy such as stainless steel, a copper-based alloy, a nickel-based alloy, a titanium-based alloy, or the like. This vibration plate 30 is joined to the upper surface of the cavity plate 40 in a state that the vibration plate 30 covers the plurality of pressure chambers 14. The upper surface of the vibration plate 30 which is made of a metal and has conductivity sandwiches the piezoelectric layer 31 between the same and the plurality of individual electrodes 32, serving also as a common electrode which generates an electric field in a direction of the thickness (thickness direction) of the piezoelectric layer 31. Therefore, it is not necessary to provide a common electrode separately from the vibration plate 30, and thus the construction of the piezoelectric actuator 5 becomes simple. Further, the vibration plate 30 as the common electrode is always held at a ground potential.

On the upper surface of the vibration plate 30, the piezoelectric layer 31 is formed. The piezoelectric layer 31 is made of a piezoelectric material mainly composed of lead zirconate titanate (PZT) that is a solid solution of lead titanate and lead zirconate and is a ferroelectric substance. This piezoelectric layer 31 is formed continuously so as to cover the plurality of pressure chambers 14. The piezoelectric layer 31 is subjected to polarization in its thickness direction.

A plurality of individual electrodes 32, each of which has a substantially elliptical shape that is somewhat smaller than one of the plurality of pressure chambers 14, are formed on the upper surface of the piezoelectric layer 31 corresponding to the pressure chambers 14, respectively. Each of the individual electrodes 32 is disposed in an area facing one of the pressure chambers 14 corresponding thereto so as to face the central portion of the corresponding pressure chamber 14, the central portion being different from the periphery portions of each of the pressure chambers 14. Each of the individual electrodes 32 is made of a conductive material such as gold, copper, silver, palladium, platinum, titanium or the like. To these plurality of individual electrodes 32, wirings of an unillustrated flexible wiring member such as flexible printed circuit (FPC) are electrically connected respectively, and the plurality of individual electrodes 32 are electrically connected to a driver IC (not shown) via the wirings of the wiring member, respectively. When the piezoelectric actuator 5 is driven, a predetermined drive voltage is applied from the driver IC to a certain individual electrode 32 among the individual electrodes 32 corresponding to a desired nozzle 20, among the plurality of nozzles 20, from which the ink is to be jetted.

Next, the action of the piezoelectric actuator 5 during the ink jetting will be described. When a drive voltage is selectively applied to the plurality of individual electrodes 32 from the driver IC, potential difference is generated between individual electrodes 32, among the plurality of individual electrodes 32 on the upper side of the piezoelectric layer 31, to which the drive voltage has been applied and the vibration plate 30 as the common electrode disposed below or under the piezoelectric layer 31 and held at the ground potential. Due to the potential difference, an electric field in the thickness direction of the piezoelectric layer 31 is generated at a portion of the piezoelectric layer 31 sandwiched between the individual electrodes 32 and the vibration plate 30. Then, since the polarization direction of the piezoelectric layer 31 and the direction of the electric field are same, the piezoelectric layer 31 expands in the thickness direction as the polarization direction, and contracts in the horizontal direction. Accompanying with the contraction and deformation of the piezoelectric layer 31, an area or portion of the vibration plate 30 facing pressure chambers 14 among the plurality of pressure chambers 14 corresponding to the individual electrodes 32 is displaced toward the pressure chambers 14 and the vibration plate 30 deforms to project toward the pressure chambers 14. At this time, the volumes of the pressure chambers 14 are reduced, thereby applying the pressure to the ink inside the pressure chambers to jet the ink droplets from nozzles 20, among the plurality of nozzles 20, which communicate with the pressure chambers 14.

Next, a method for producing the ink jet head 1 of this embodiment will be described. First, among the plates 40 to 46 constructing the channel unit 4, an ink channel including the plurality of pressure chambers 14 and manifolds 17, etc., is formed by etching in the six metal plates 40 to 45 except for the nozzle plate 46 (channel forming step). In particular, in the manifold plate 44, four manifolds 17*a* to 17*d* corresponding to one of the pressure-chamber rows are formed so that the manifolds 17*a* to 17*d* extend mutually adjacently in parallel along the row direction of the pressure chambers 14 (direction perpendicular to the sheet surface of FIG. 7). Further, in the aperture plate 42, a plurality of throttle channels 11 having different lengths are formed while adjusting the widths thereof such that the throttle channels 11 have channel resistances which are same.

Next, seven metal plates in total, including the six plates 40 to 45 and the vibration plate 30 which is made of metal material and which is included in the piezoelectric actuator 5 are stacked and joined (joining step). In this joining step, the seven metal plates are joined by the metal diffusion bonding. That is, as shown in FIG. 7, the stacked body 50 formed of the seven metal plates is sandwiched by a pair of jigs 51 and 52, and the stacked body 50 is pressurized for several hours by the pair of jigs 51 and 52 while being heated to a high temperature (for example, about 1,000 degrees C.). Then, metal particles diffuse each other on the contact surfaces of the metal plates, whereby the seven metal plates are joined.

Figure 8:
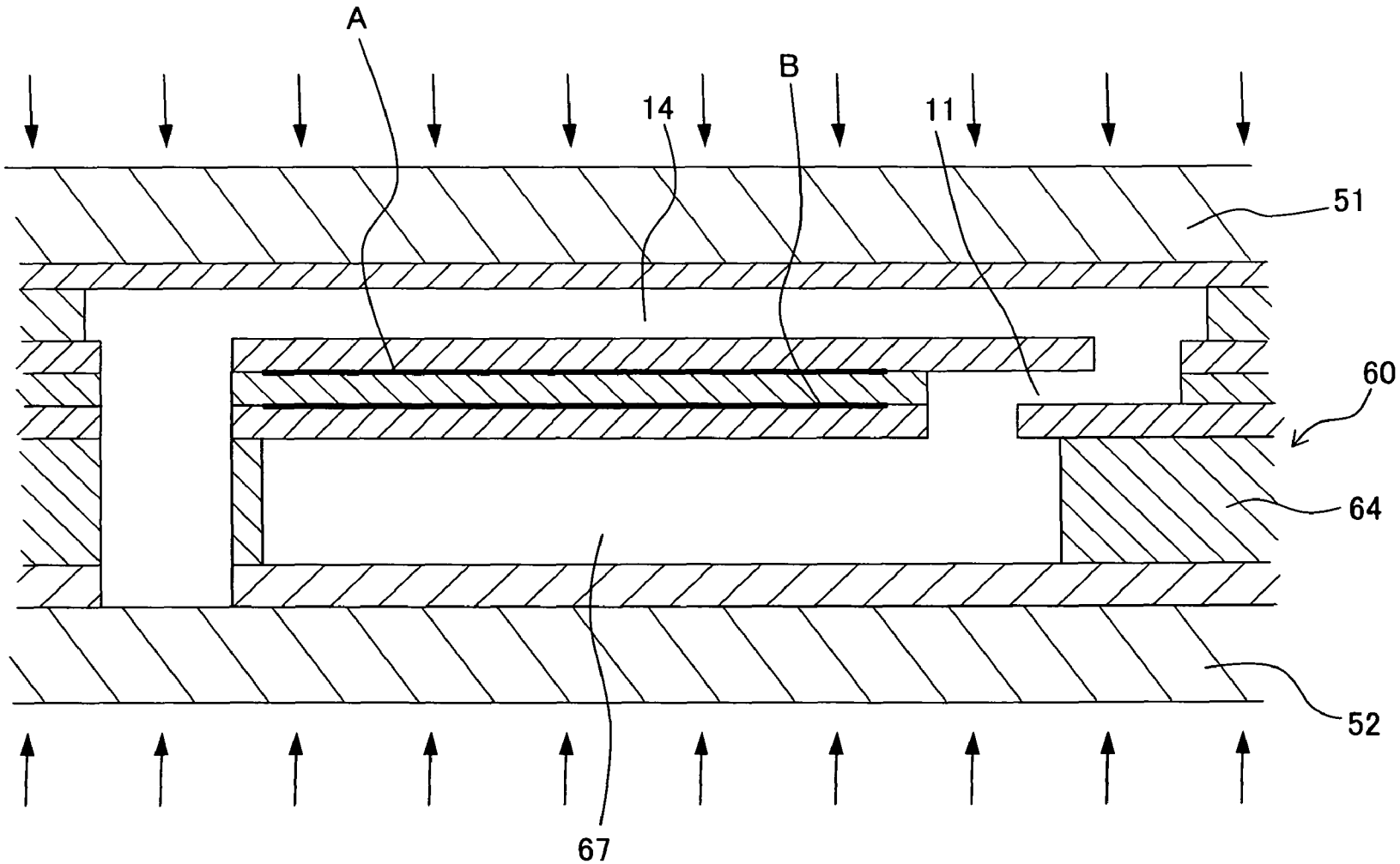
FIG. 8 is a view showing a step of joining in a conventional construction in which a manifold is not divided.

In this metal diffusion bonding, if the base area (area with respect to the plane direction of the plate) of the manifold existing in the stacked body of the metal plates is large, it is difficult to satisfactorily join the metal plates in some cases. FIG. 8 shows a joining step using the metal diffusion bonding in a case that a manifold 67 which supplies the ink to one pressure-chamber row is not divided. In this case, the area of the manifold 67 existing in a stacked body 60 of the metal plates is large. Therefore, it is difficult to pressurize portions facing the cavity of the manifold 67 (portions A and B in FIG. 8) among joining portion at which the metal plates, other than the manifold plate 64, are joined together. Due to this, any sufficient joining cannot be realized.

Figure 7:
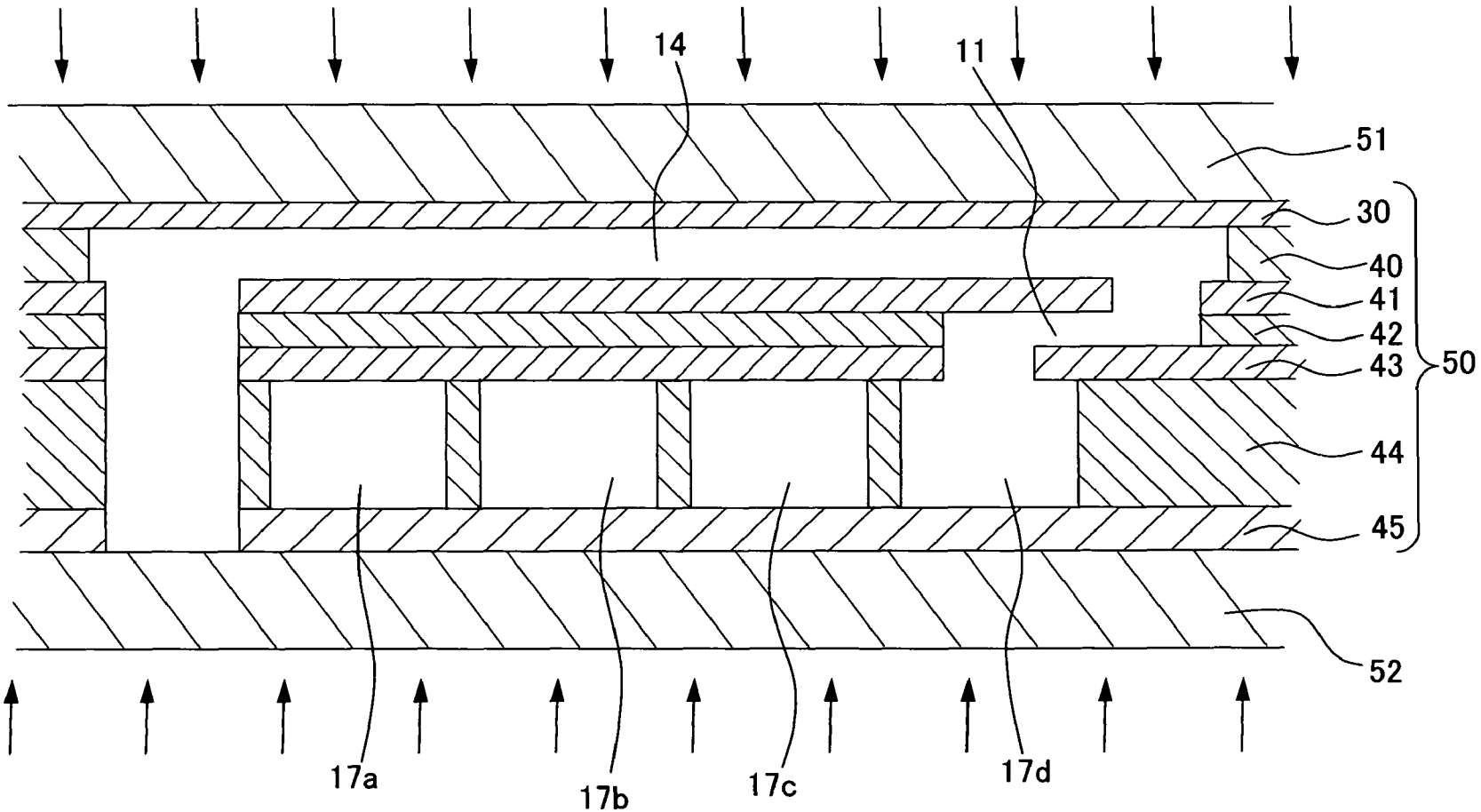
FIG. 7 is a view showing a step of joining metal plates.

On the other hand, as shown in FIG. 7, in the production method of this embodiment, the manifold corresponding to one of the pressure-chamber rows is divided into four manifolds 17*a* to 17*d*. Accordingly, the width (area) of each portion of the divided manifold 17 (the manifolds 17*a* to 17*d*) becomes smaller, and thus joining portions at which the metal plates, other than the manifold plate 44, are joined to each other, are reliably pressurized even at areas facing the manifolds 17, thereby performing the joining reliably.

Figure 9:
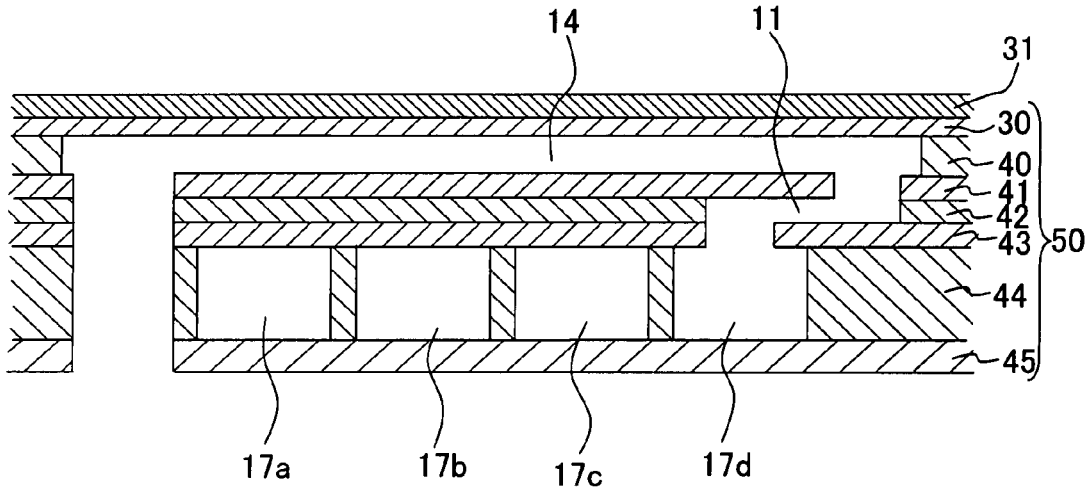
FIG. 9 is a view showing a step of forming piezoelectric layer.

After joining the seven metal plates as described above, a piezoelectric layer 31 is formed continuously on the upper surface of the vibration plate 30 at an area facing the pressure chambers 14, as shown in FIG. 9 (piezoelectric layer forming step). This piezoelectric layer 31 can be formed by depositing particles of a piezoelectric material on the upper surface of the vibration plate 30. It is possible to use, as such a particle deposition method, for example, the aerosol deposition method (AD method) in which particles are deposited by jetting an aerosol containing the particles and a carrier gas onto a base material, the chemical vapor deposition method (CVD method), the sputtering method, or the like. Alternatively, the piezoelectric layer 31 may be formed by adhering a piezoelectric sheet, obtained by sintering a green sheet, to the upper surface of the vibration plate 30 with an adhesive agent.

Figure 10:
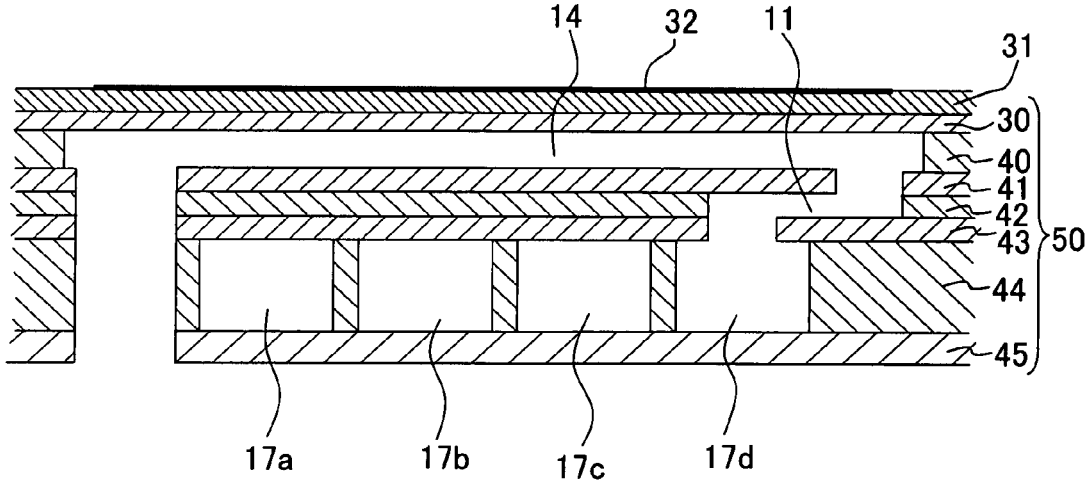
FIG. 10 is a view showing a step of electrode-formation.

Next, as shown in FIG. 10, a plurality of individual electrodes 32 are formed on the upper surface of the piezoelectric layer 31 (electrode forming step). The plurality of individual electrodes 32 can be formed by the screen printing method, the vapor deposition method, the sputtering method, or the like.

Figure 11:
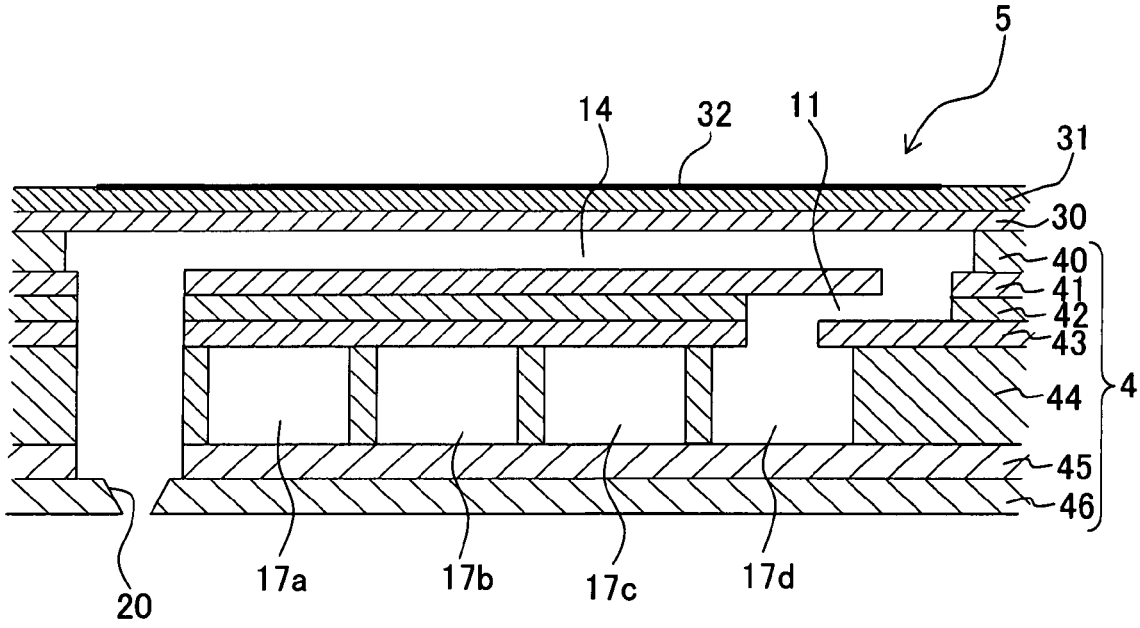
FIG. 11 is a view showing a step of joining nozzle plate.

Lastly, as shown in FIG. 11, the nozzle plate 46 made of a synthetic resin is joined to the lower surface of the cover plate 45 with an adhesive agent or the like to complete the channel unit 4, thereby finishing the production of the ink jet head 1.

In the production process of the ink jet head 1 as described above, when the nozzle plate 46 is a metal plate made of stainless steel or the like, eight metal plates including the above-described seven metal plates (vibration plate 30, cavity plate 40, base plate 41, aperture plate 42, supply plate 43, manifold plate 44, and cover plate 45) and the nozzle plate 46 are joined at a time by the metal diffusion bonding.

According to the above-described ink jet head 1 and the method for producing the same as described above, the following effects can be obtained. That is, by dividing the wide manifold corresponding to one of the pressure-chamber rows into four manifolds 17*a* to 17*d*, the width of each of the manifold 17*a* to 17*d* becomes narrow. Therefore, when the plurality of metal plates including the manifold plate 44 are joined by the metal diffusion bonding, the joining portions, at which the metal plates are joined to each other, are sufficiently pressurized also at areas facing the manifolds 17*a* to 17*d*, thereby realizing the reliable joining.

Further, the divided four manifolds 17*a* to 17*d* extend in parallel along the row direction of the pressure chambers 14 in a state that the manifolds 17*a* to 17*d* are mutually adjacent. Therefore, it is possible to make the ink channel including the manifolds 17 to be compact as a whole, thereby making the size of the ink jet head 1 to be small.

Furthermore, by communicating the mutually adjacent pressure chambers 14 with different divided portions of the manifold 17 (manifolds 17*a* to 17*d*), respectively, any change in the pressure of the ink in a certain pressure chamber 14 is prevented from propagating via the manifold 17 to another pressure chamber 14 adjacent to the certain pressure chamber 14, thereby suppressing the crosstalk. Moreover, when an attempt is made to communicate the plurality of pressure chambers 14 arranged in a row and the four manifolds 17*a* to 17*d* with each other via the throttle channels 11 (main portions of communication channels) extending in orthogonal direction orthogonal to the row direction, then the lengths of the throttle channels 11 are consequently different. However, since the widths of the throttle channels 11 are adjusted so that the plurality of communication channels 13 are formed in a shape to have channel resistances which are same, it is possible to suppress any variation in the ink amount to be supplied to the plurality of pressure chambers 14 and to prevent any variation in the jetting characteristic among the plurality of nozzles 20.

Next, an explanation will be given about modifications in which various changes are made to the above-described embodiment. However, any parts or components constructed in the same manner as in the above-described embodiment are designated with same reference numerals, and description thereof is omitted as appropriate.

The number of divided portions of the manifold 17 to be provided for the plurality of pressure chambers 14 arranged in a row is not limited to four, and the divided portions of the manifold 17 may be provided in a number other than four.

Figure 12:
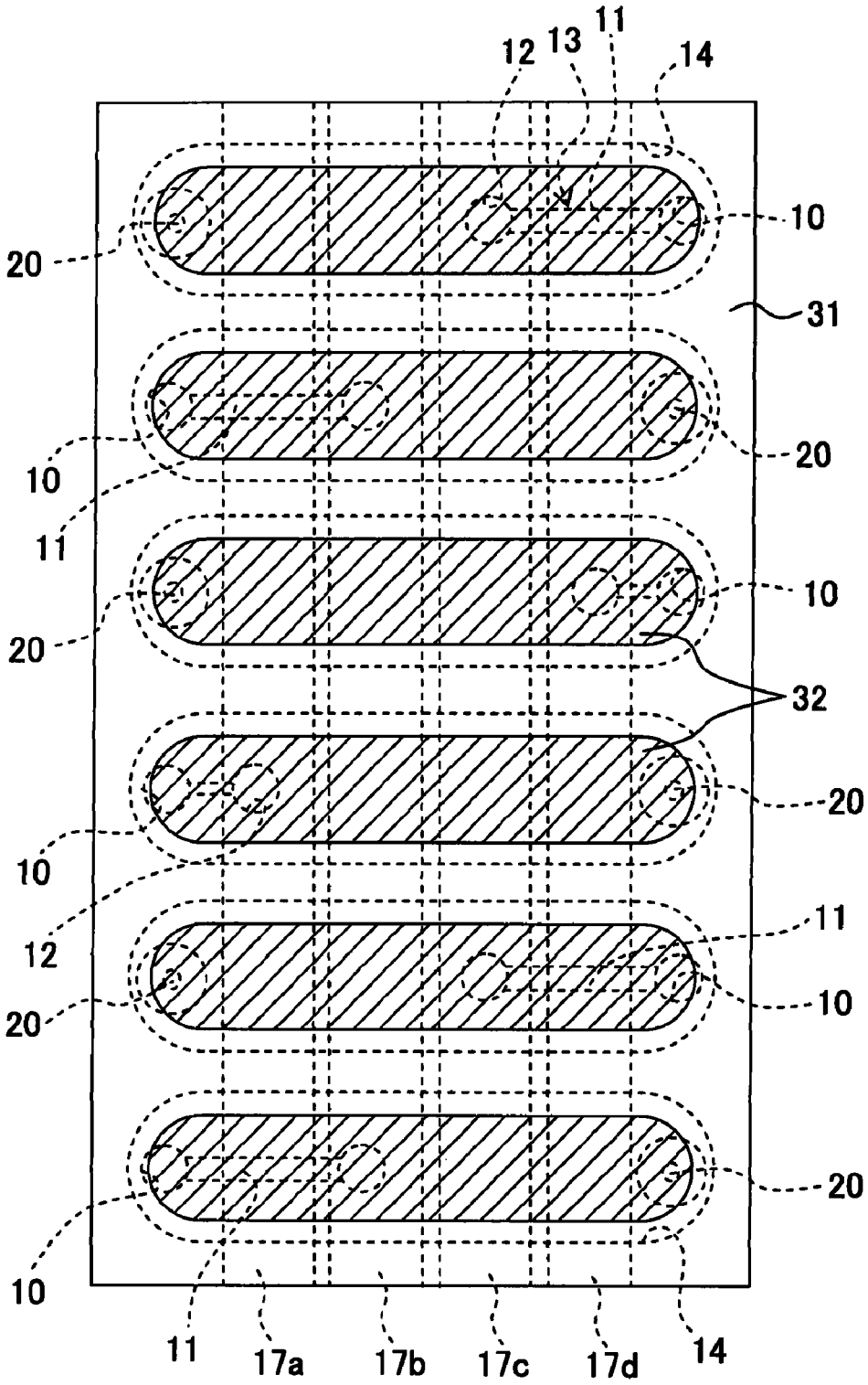
FIG. 12 is a partially enlarged plan view of an ink jet head according to a modification.

It is not necessarily indispensable that the plurality of nozzles 20, communicating with the plurality of pressure chambers 14 arranged in a row, are arranged in a row along the row direction of the pressure chambers 14 in the same manner as in the embodiment (see FIGS. 2 and 3). For example, as shown in FIG. 12, it is also allowable that a plurality of pressure chambers 14 are arranged in a row, and that a plurality of nozzles 20 communicating with these pressure chambers 14, respectively, are arranged alternately on one ends and the other ends of the pressure chambers 14, thereby arranging the plurality of nozzles 20 in two rows in a staggered manner. In this case, the through holes 10, which are formed in the base plate to be positioned on the side opposite to the nozzles 20 with respect to the longitudinal direction of the pressure chambers 14, are also arranged in two rows in a staggered manner. Also in this case, by communicating the through holes 10 arranged in the staggered manner and the four manifolds 17*a* to 17*d* arranged to be overlapped with the pressure-chamber row via two types of throttles channels 11 having different lengths and/or widths, it is possible to communicate mutually adjacent pressure chambers 14 with the different manifolds 17 via the communication channels 13, respectively, and it is possible to make the channel resistances of the communication channels 13 to be same with each other.

In the above-described embodiment, since the throttle channels 11 (main portions of the communication channels 13 communicating the manifolds 17 and the pressure chambers 14) extend in the orthogonal direction orthogonal to the row direction of the pressure chambers 14, a construction is adopted in which the lengths of the plurality of throttle channels 11 are different from each other so as to communicate mutually adjacent pressure chambers 14 with different manifolds 17 (see FIGS. 2 and 3). However, by forming a plurality of throttle channels extending in mutually different directions, it is possible to make the channel lengths of these throttle channels can be made same with each other.

Figure 13:
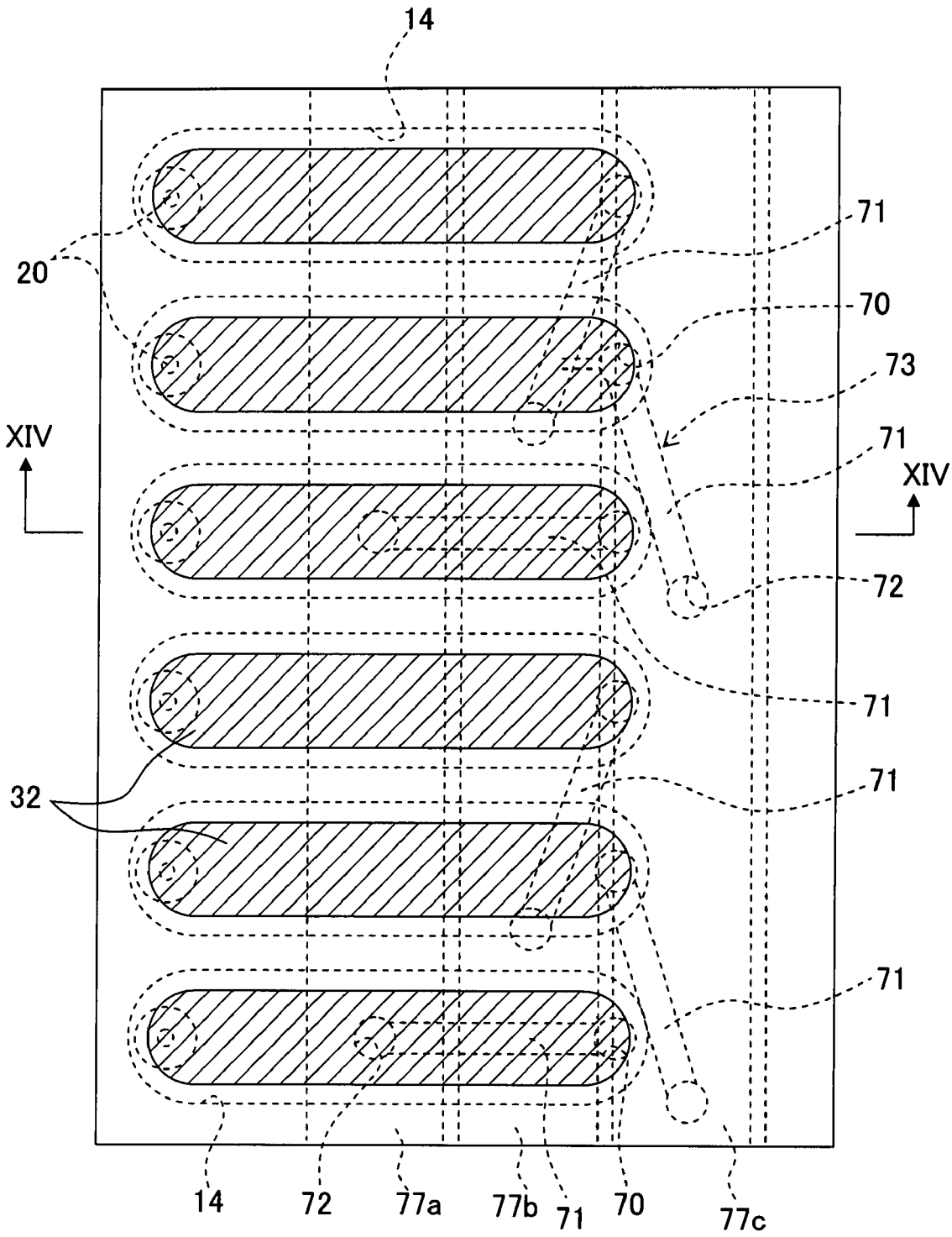
FIG. 13 is a partially enlarged plan view of an ink jet head according to another modification.
Figure 14:
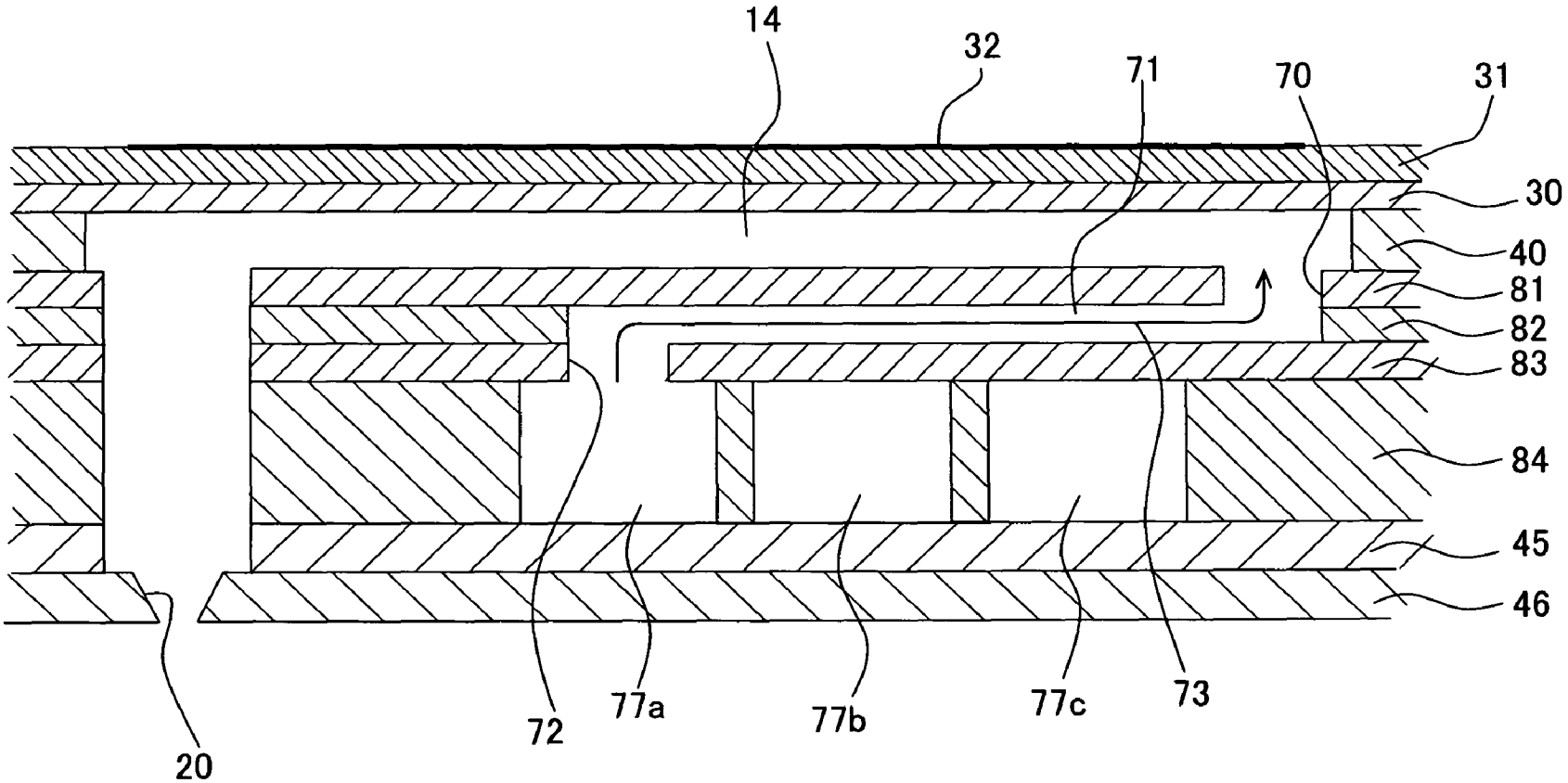
FIG. 14 is a sectional view taken along the XIV-XIV line of FIG. 13.

For example, in an ink jet head shown in FIGS. 13 and 14, three manifolds 77*a*, 77*b*, and 77*c* are formed in the manifold plate 84 with respect to a plurality of pressure chambers 14 arranged in a row. The pressure chambers 14 forming the pressure-chamber row communicate with the three manifolds 77*a*, 77*b*, and 77*c* in an arrangement order of the pressure chambers 14 via communication channels 73, respectively, the communication channels 73 being formed by through holes 72 in a supply plate 83, throttle channels 11 in a aperture plate 82, and through holes 70 in a base plate 81. Namely, mutually adjacent pressure chambers 14, among the pressure chambers 14, communicate with different manifolds 77*a*, 77*b*, and 77*c* respectively. Here, as shown in FIG. 13, a certain throttle channel 71 communicating with a certain pressure chamber 14 extends in an extending direction which intersects the extending direction of another throttle channel 71 communicating with another pressure chamber 14 adjacent to the certain pressure chamber 14. Therefore, the lengths of the three types of throttle channels 71 communicating with the three manifolds 77*a*, 77*b*, and 77*c* respectively can be made equal to each other. Therefore, in the modification, the communication channels 73 including the throttle channels 71 can be made to have channel resistances which are all same without changing the widths of the throttle channels 71, which is different from the construction of the above-described embodiment.

In the above-described embodiment, mutually adjacent pressure chambers among the plurality of pressure chambers communicate with different manifolds so as to suppress the crosstalk between the mutually adjacent pressure chambers. However, it is not necessarily indispensable that the mutually adjacent pressure chambers are communicated with the different manifolds respectively. That is, in the liquid-droplet jetting apparatus of the present invention, an effect is obtained that the joining of the metal plates by the metal diffusion bonding becomes satisfactory by dividing the manifold which supplies the ink into one pressure-chamber row into a plurality of manifolds, regardless of the construction for providing the communication between pressure chambers and manifolds. In addition, in the liquid-droplet jetting apparatus, owing the construction in which the divided manifolds extend mutually adjacently along the row direction of the pressure chambers and the channel resistances of the communication channels communicating the pressure chambers and the manifolds respectively are equal to each other, the effect is obtained in that the ink channels can be made compact (the size of the apparatus can be made small) while suppressing the variation in the liquid droplet jetting characteristic.

The above-described embodiment and modifications thereof are examples in each of which the present invention is applied to an ink jet head which jets an ink from nozzles. However, the object to which the present invention is applicable is not limited to such an ink jet head. For example, the present invention is applicable to various kinds of liquid-droplet jetting apparatuses such as a liquid-droplet jetting apparatus which forms a fine wiring pattern on a substrate by jetting a conductive paste, a liquid-droplet jetting apparatus which forms a high-resolution display by jetting an organic luminous body or organic illuminant onto the substrate, a liquid-droplet jetting apparatus which forms a minute electronic device such as an optical waveguide by jetting an optical resin onto the substrate, or the like.

What is claimed is:

1. A liquid-droplet jetting apparatus which jets a droplet of a liquid, comprising:

a channel unit having a liquid channel formed therein, the liquid channel having:

a plurality of nozzles;

a plurality of pressure chambers which communicate the liquid with the nozzles respectively and which are arranged in a row in a predetermined plane along a predetermined row direction;

a plurality of liquid supply chambers which are arranged to be mutually adjacent and which extend in the predetermined row direction; and a plurality of communication channels each of which communicates the liquid with one of the pressure chambers and one of the liquid supply chambers and which are formed in a shape so that the communication channels have channel resistances which are same;

wherein the liquid passes through both the pressure chambers and the liquid supply chambers; and a jetting-pressure applying mechanism which applies jetting pressure to the liquid in the pressure chambers;

wherein the plurality of communication channels have channel lengths which are mutually different;

wherein, among the plurality of communication channels a communication channel having a longer channel length than another communication channel has a larger channel cross sectional area than that of the another communication channel; and wherein each of the liquid supply chambers is communicated with plural nozzles, plural pressure chambers, and plural communication channels, respectively.

2. The liquid-droplet jetting apparatus according to claim 1;

wherein the plurality of communication channels have main portions extending in an orthogonal direction orthogonal to the predetermined row direction.

3. The liquid-droplet jetting apparatus according to claim 1;

wherein the plurality of communication channels have main portions extending in a predetermined extending direction respectively; and wherein the main portions of the communication channels are arranged in another plane parallel to the plane.

4. The liquid-droplet jetting apparatus according to claim 1;

wherein the pressure chambers and the liquid supply chambers are partially overlapped.

5. The liquid-droplet jetting apparatus according to claim 1;

wherein the nozzles are arranged in a row in the row direction of the pressure chambers.

6. The liquid-droplet jetting apparatus according to claim 1;

wherein the channel unit has a stacked body formed of a plurality of metal plates including a plate in which the liquid supply chambers are formed.

7. The liquid-droplet jetting apparatus according to claim 1;

wherein the plurality of liquid supply chambers have a communication portion formed at one ends in the predetermined row direction of the liquid supply chambers, the communication portion extending to communicate the liquid supply chambers with each other.

8. The liquid-droplet jetting apparatus according to claim 7;

wherein the plurality of pressure chambers have through holes formed therein respectively, each of the through holes communicating one of the pressure chambers and one of the liquid supply chambers; and wherein through holes, among the through holes, which are formed in two adjacent pressure chambers among the plurality of pressure chambers, are formed at mutually different positions in an orthogonal direction orthogonal to the predetermined row direction.

9. The liquid-droplet jetting apparatus according to claim 1;

wherein the communication channels include a first communication channel and a second communication channel;

wherein the first communication channel is longer than the second communication channel in a direction in which the plurality of liquid supply chambers are arranged; and wherein a channel resistance of the first communication channel is substantially equal to a channel resistance of the second communication channel.

10. The liquid-droplet jetting apparatus according to claim 1;

where two adjacent communication channels, of the communication channels, are connected to two different liquid supply chambers, of the liquid supply chambers, respectively.

11. The liquid-droplet jetting apparatus according to claim 1;

wherein each of the pressure chambers overlaps with all of the liquid supply chambers.

12. The liquid-droplet jetting apparatus according to claim 9;

wherein each of the pressure chambers overlaps with all of the liquid supply chambers.

* * * * *